United States Patent [19]

Kontz

[11] Patent Number: 4,472,217

[45] Date of Patent: Sep. 18, 1984

[54] APPARATUS FOR ORIENTING THE SEAM OF A CONICAL LABEL

[75] Inventor: Robert F. Kontz, Toledo, Ohio

[73] Assignee: Owens-Illinois, Inc., Toledo, Ohio

[21] Appl. No.: 550,340

[22] Filed: Nov. 10, 1983

[51] Int. Cl.[3] ..... B65b 7/28

[52] U.S. Cl. ..... 156/64; 53/367; 53/585; 156/350; 156/569

[58] Field of Search ..... 156/64, 350, 569, 570, 156/556; 53/585, 307, 139.3, 582, 367

[56] References Cited

U.S. PATENT DOCUMENTS

| | | | |
|---|---|---|---|
| 3,611,662 | 10/1971 | Schmitt | 53/367 X |
| 3,626,658 | 12/1971 | Jones | 53/307 X |
| 4,285,186 | 8/1981 | Desom | 53/367 X |

*Primary Examiner*—David A. Simmons

*Attorney, Agent, or Firm*—John R. Nelson; Myron E. Click

[57] ABSTRACT

Apparatus and method for orienting the seam of a cylindrical sleeve label or conical label, the label being of a heat shrinkable plastic material and being formed of a length of the plastic with an overlie to form a seam, means for holding a stacked column of labels, means for rotating the labels including rollers, aligning means for aligning the seam of each label at the bottom of the stack, the aligning means including aligned wire fingers that contact the seam and stop the rotation of the label container, each label being adapted for application over the top of a container to form a sleeve label thereon.

6 Claims, 3 Drawing Figures

APPARATUS FOR ORIENTING THE SEAM OF A CONICAL LABEL

The present invention relates to apparatus and methods for orienting the seam of a cylindrical or conical plastic sleeve label.

It is an object of the present invention to provide apparatus for orienting the seams of conical sleeve labels so they can be efficiently and quickly repeatedly aligned in the same position for application to containers in the continuous efficient production of labeled containers.

It is an object of the present invention to provide an apparatus for locating and aligning a seam of a cylindrical oriented plastic sleeve label, the label being heat shrinkable and formed from a length of plastic with both ends overlapped to form a sleeve, the apparatus comprising means for holding a stack of nested hollow labels at an angle inclined to the horizontal, means to support and rotate the labels including two spaced apart rolls, means to rotate the rolls, and aligning means operably attached to the rolls and spaced apart from the bottom label, the aligning means including wire fingers that contact the label and stop the rotation of the label when the fingers contact the seam.

It is an object of the present invention to provide a method for locating and aligning a seam of a cylindrical or conical oriented plastic sleeve label, the label being heat shrinkable and formed from a length of plastic with both ends overlapped to form a sleeve with a seam, the method comprising the steps of holding a stack of nested hollow labels at an angle inclined to the horizontal, supporting the labels on two spaced apart rolls also inclined with respect to the horizontal, rotating the rolls to rotate the stack of labels, and contacting the seam of the bottom cup with a contacting member, stopping the rotation of the stack and rolls, and aligning the seam in the same position for repeated removal of the label by the contact of the seam with the contacting member.

Figure 1:
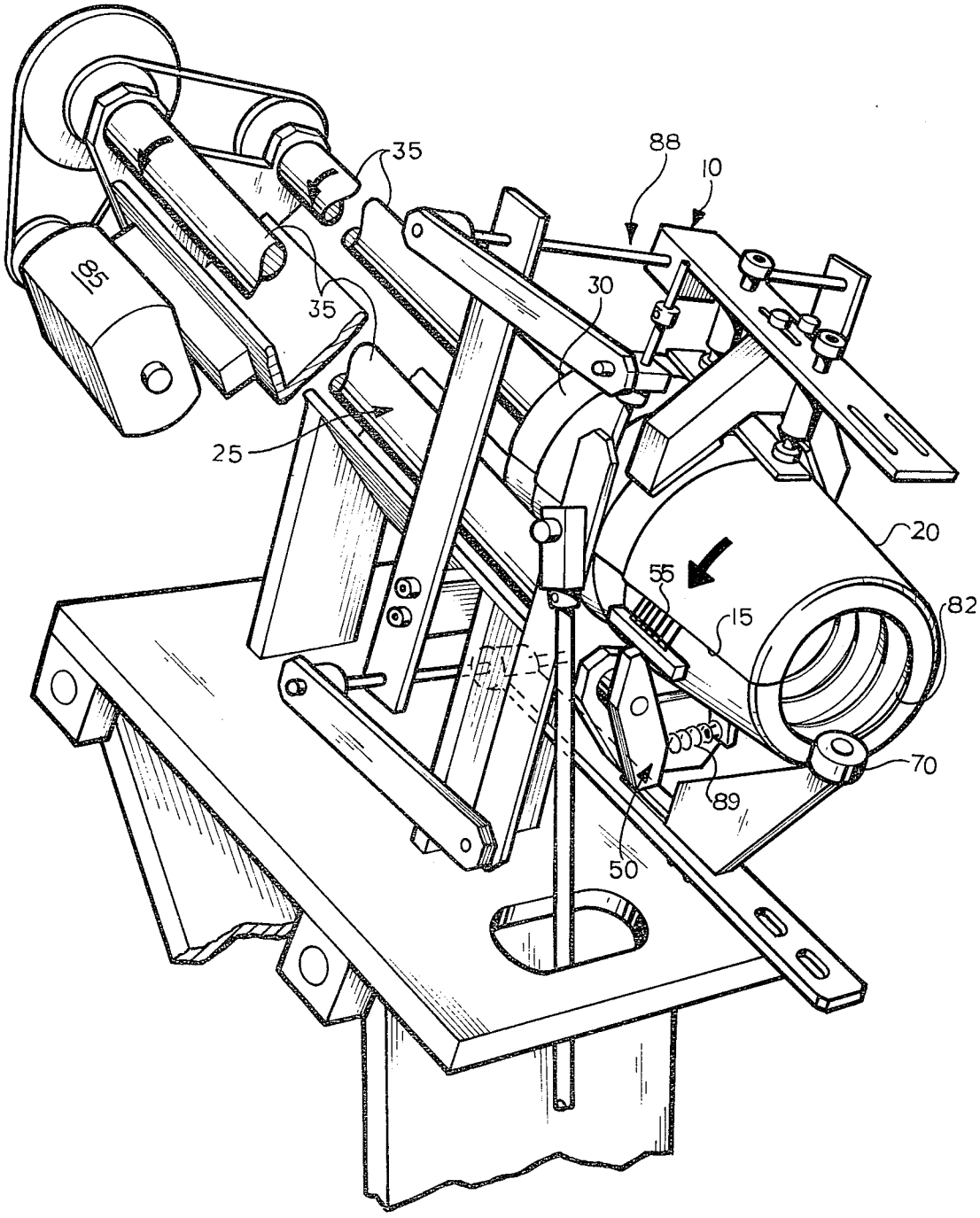
Figure 2:
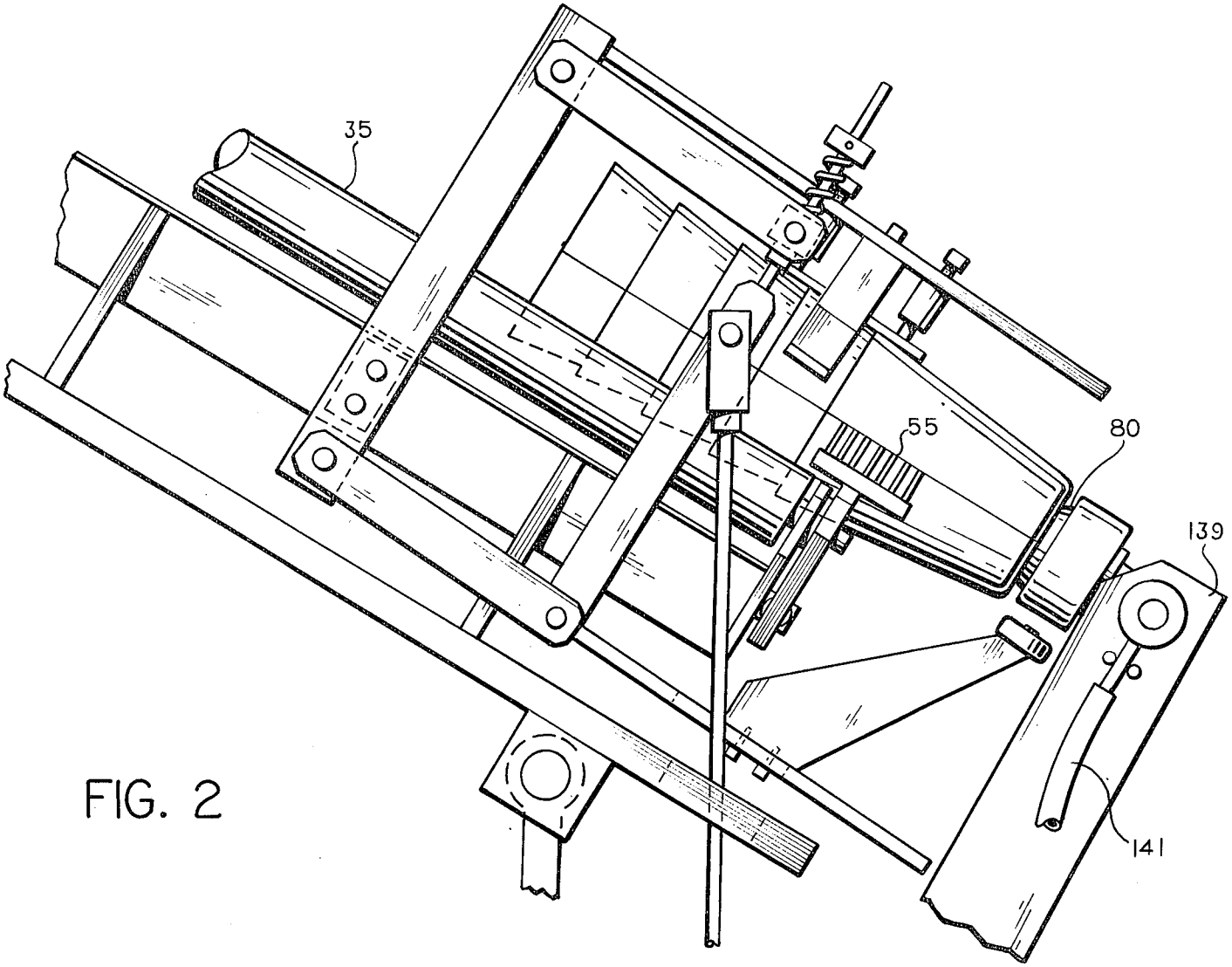
Figure 3:
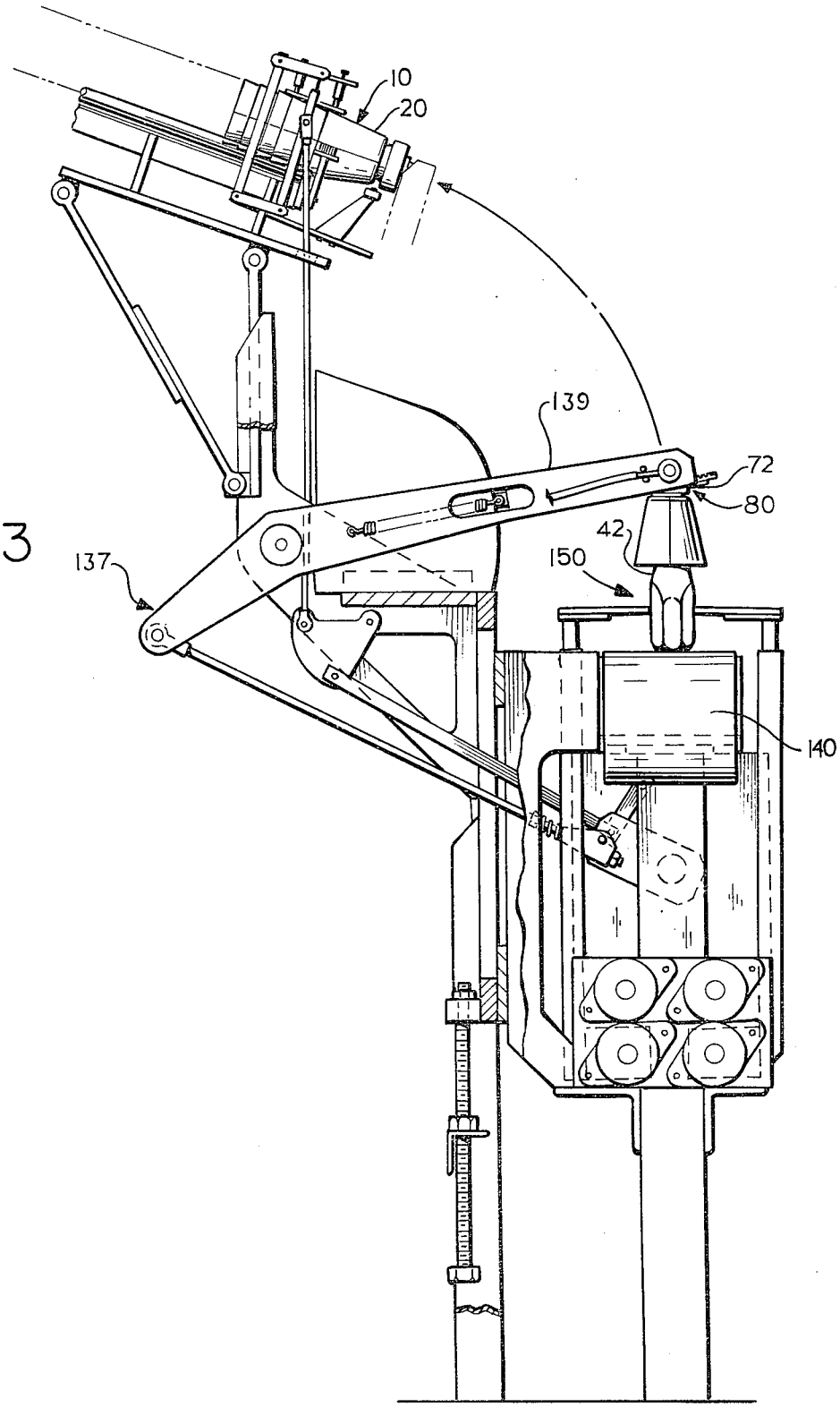

These and other objects will be apparent from the specification that follows, the appended claims, and the drawings, in which:

FIG. 1 is a perspective view of an orienting apparatus of the present invention, FIG. 2 is a fragmentary side elevational view showing the orienting apparatus assembled with a label transferring device for applying labels to containers, and FIG. 3 is a fragmentary elevational view of the orienting apparatus of FIGS. 1 and 2 assembled with a transfer assembly for applying a label to a container.

The present invention provides an apparatus for orienting the seam of a cylindrical sleeve label or conical label, the label being of a heat shrinkable plastic material and being formed of a length of the plastic with an overlie to form a seam, means for holding a stacked column of labels, means for rotating the labels including rollers, aligning means for aligning the seam of each label at the bottom of the stack, the aligning means including aligned wire fingers that contact the seam and stop the rotation of the label container, each label being adapted for application over the top of a container to form a sleeve label thereon.

The present invention also provides a method for locating and aligning a seam of a cylindrical or conical oriented plastic sleeve label, the label being heat shrinkable and formed from a length of plastic with both ends overlapped to form a sleeve with a seam, the method comprising the steps of holding a stack of nested hollow labels at an angle inclined to the horizontal, supporting the labels on two spaced apart rolls also inclined with respect to the horizontal, rotating the rolls to rotate the stack of labels, and contacting the seam of the bottom cup with a contacting member stopping the rotation of the stack and rolls and aligning the seam in the same position for repeated removal of the label by the contact of the seam with the contacting member.

As is seen in the drawings, an orienting apparatus 10 is shown, the apparatus efficiently and accurately orienting a seam 15 of a hollow conical sleeve label 20, the label being formed from a length of heat shrinkable oriented plastic such as polystyrene or polyethylene that is preferably a laminate of a layer of solid polymer and a layer of a foamed polymer. The length of plastic is overlapped at the ends to form the seam 15.

A label holding structure 25 is provided for holding a stack 30 of nested labels 20, the structure including a pair of spaced apart rolls 35 generally inclined at an angle to the horizontal to support the stack 30 and rotate the stack at an angle inclined generally about 30° to 60° with respect to the horizontal.

The labels 20 are preferably applied to a container 40 having a neck 42 to provide a pilfer-proof closure for the top of the container.

Aligning means 50 is provided to align and orient the seam of the bottom label preferably by wire fingers 55 that directly contact the seam of the bottom label when the stack is rotated.

There is provided means 60 for driving the rolls and means is provided to stop the rotation of the rolls when the outer portion of the wire fingers 55 contact the seam.

A ball bearing 70 is provided on the support structure at the bottom of the stack. The ball bearing rotates as the stack rotates, there being ball bearing moving means 75 to move the bearing 70 out of the way just prior to removal of the bottom label from the stack by a transfer arm head 80 that is adapted to pick up the label through an opening 82 in the label bottom, the transfer arm adapted to move the label down to the container in an arc that resembels a woodpecker-like action. The label is turned 180° and placed on the container as described in U.S. patent application of Robert F. Kontz and Gary Moore, the application being filed concurrently herewith and entitled "Apparatus and Methods for Applying Heat Shrinkable Plastic Labels to Containers" (at S.N. 550412), and assigned to the same assignee as that of the present application.

The present method and apparatus are well suited for a high production line in which conical sleeve labels are applied to the top of containers or the bottom thereof as a base label.

Means for stopping the rotation of the column of labels is shown, the aligning fingers touch the seam of the bottom label and the column slips but does not rotate on the rollers that keep turning. A motor 85 is provided to rotate the rollers 35. An escapment mechanism feed 88 is shown and a spring 89 is provided to bias the wire fingers 55 against the bottom label.

The label applying station 150 is shown in FIG. 3 in which a plunger 72 of the transfer head 80 of the transferring means 137 delivers the label 20 to the bottle 42, one label being delivered to each container as the containers are moved along by the conveyor 140.

As set forth in the previously mentioned application S.N. 550412 filed Nov. 10, 1983 incorporated here by reference, an air line 141 is provided on the upper portion 139 of the transfer arm for the operation of the transfer head 80 and the plunger 72.

What is claimed is:

1. An apparatus for orienting the seam of a cylindrical sleeve label or conical label, the label being of a heat shrinkable plastic material and being formed of a length of the plastic with an overlie to form a seam, means for holding a stacked column of labels, means for rotating the labels including rollers, aligning means for aligning the seam of each label at the bottom of the stack, the aligning means including aligned wire fingers that contact the seam and stop the rotation of the label container, each label being adapted for application over the top of a container to form a sleeve label thereon.

2. An apparatus as defined in claim 1 in which the means for rotating the column of labels includes a pair of rotating bars for spinning the column until the sensing means finds the seam.

3. An apparatus as defined in claim 1 in which a ball bearing is provided at the bottom of the stack to rotate while the stack is rotated, the ball bearing moving out of the way just prior to arrival of a transfer arm head.

4. An apparatus as defined in claim 1 in which the rollers and wire fingers are so constructed and arranged that the fingers contact the seam and hold the seam there, the column being held sufficiently to slip on the rollers rather than rotate thereon.

5. An apparatus for locating and aligning a seam of a cylindrical oriented plastic sleeve label, the label being heat shrinkable and formed from a length of plastic with both ends overlapped to form a sleeve, the apparatus comprising:

means for holding a stack of nested hollow labels at an angle inclined to the horizontal, means to support and rotate the labels including two spaced apart rolls, means to rotate the rolls, and aligning means operably attached to the rolls and spaced apart from the bottom label, the aligning means including wire fingers that contact the label and stop the rotation of the label when the fingers contact the seam.

6. A method for locating and aligning a seam of a cylindrical or conical oriented plastic sleeve label, the label being heat shrinkable and formed from a length of plastic with both ends overlapped to form a sleeve with a seam, the method comprising the steps of:

holding a stack of nested hollow labels at an angle inclined to the horizontal, supporting the labels on two spaced apart rolls also inclined with respect to the horizontal, rotating the rolls to rotate the stack of labels, and contacting the seam of the bottom cup with a contacting member stopping the rotation of the stack and rolls and aligning the seam in the same position for repeated removal of the label by the contact of the seam with the contacting member.

* * * * *